US012281570B1

(12) United States Patent
Alobaidan et al.

(10) Patent No.: US 12,281,570 B1
(45) Date of Patent: Apr. 22, 2025

(54) APPARATUS AND METHOD FOR IN-SITU MONITORING OF HYDROGEN LEVELS AT A SUBSURFACE LOCATION

(71) Applicant: SAUDI ARABIAN OIL COMPANY, Dhahran (SA)

(72) Inventors: Ibrahim Alobaidan, Dammam (SA); Abdallah A. Alshehri, Dhahran (SA); Klemens Katterbauer, Dhahran (SA); Ali Abdallah AlYousef, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/635,909

(22) Filed: Apr. 15, 2024

(51) Int. Cl.
*E21B 49/08* (2006.01)
*E21B 17/10* (2006.01)

(52) U.S. Cl.
CPC ..... *E21B 49/0875* (2020.05); *E21B 17/1021* (2013.01)

(58) Field of Classification Search
CPC ..... E21B 49/0875; E21B 17/1021
See application file for complete search history.

(56) References Cited

U.S. PATENT DOCUMENTS 3,908,122 A 9/1975 Hartsell
6,115,528 A * 9/2000 Schmucker ..... G01N 21/59 385/12
7,595,876 B2 9/2009 DiFoggio
7,699,114 B2 4/2010 Ullah et al.
8,319,657 B2 11/2012 Godager
8,800,384 B2 8/2014 Wootten
8,867,040 B2 10/2014 Pope et al.
9,074,462 B2 7/2015 Pearce
9,140,643 B2 9/2015 Bellian et al.
(Continued)

FOREIGN PATENT DOCUMENTS

CN 206807077 U 12/2017
CN 109540812 A 3/2019
EP 3479098 B1 9/2023

OTHER PUBLICATIONS

McKinley, R.M; Production Logging. Paper presented at the International Petroleum Exhibition and Technical Symposium, Beijing, China, Mar. 1982. doi: https://doi.org/10.2118/10035-MS; 32 pages.
(Continued)

*Primary Examiner* — Catherine Loikith
(74) *Attorney, Agent, or Firm* — Leason Ellis LLP

(57) ABSTRACT

A sonde adapted for determining one or more parameters related to hydrogen at a subsurface location. The sonde includes: a plurality of centralizer arms forming an interior space having a proximal portion and a distal portion; and a plurality of fiber optic Raman probes each disposed at the proximal portion or the distal portion of the interior space and proximate a respective one of the plurality of centralizer arms, the plurality of fiber optic Raman probes being adapted to measure a hydrogen concentration in a downhole measurement. The sonde also includes a plurality of optical probes each disposed at another of the distal portion or the proximal portion of the interior space and proximate a same or different one of the plurality of centralizer arms, the plurality of optical probes being adapted to measure downhole local gas holdup.

17 Claims, 7 Drawing Sheets

(56) References Cited

U.S. PATENT DOCUMENTS

| | | | |
|---|---|---|---|
| 9,243,466 | B2 | 1/2016 | Klomp et al. |
| 9,274,246 | B2 | 3/2016 | Minette et al. |
| 9,388,685 | B2 | 7/2016 | Ravi et al. |
| 9,513,241 | B2 | 12/2016 | Whittaker |
| 9,863,244 | B2 * | 1/2018 | Donzier ..... G01N 21/55 |
| 9,874,087 | B2 | 1/2018 | Jay et al. |
| 9,874,088 | B2 | 1/2018 | Fanini et al. |
| 10,088,422 | B2 | 10/2018 | Andrews et al. |
| 10,294,771 | B2 | 5/2019 | Donzier et al. |
| 10,370,915 | B2 | 8/2019 | Tolley |
| 10,677,050 | B2 | 6/2020 | Johnston et al. |
| 10,774,639 | B2 | 9/2020 | Donzier et al. |
| 10,876,394 | B2 | 12/2020 | Hill, III et al. |
| 10,941,647 | B2 | 3/2021 | Grubb et al. |
| 11,021,947 | B2 | 6/2021 | Ratcliffe et al. |
| 11,073,471 | B2 | 7/2021 | Maity |
| 11,333,625 | B2 | 5/2022 | Jones et al. |
| 11,352,839 | B2 | 6/2022 | Donzier et al. |
| 11,414,987 | B2 | 8/2022 | Fellinghaug et al. |
| 11,454,094 | B2 | 9/2022 | Chen et al. |
| 11,460,443 | B2 | 10/2022 | Al-Huwaider et al. |
| 11,530,611 | B2 | 12/2022 | Pfutzner et al. |
| 11,661,844 | B2 | 5/2023 | Al-Huwaider et al. |
| 11,680,466 | B2 | 6/2023 | Vinegar et al. |
| 11,697,978 | B2 | 7/2023 | Signerelli et al. |
| 11,725,465 | B2 | 8/2023 | Harris et al. |
| 2008/0129993 | A1 | 6/2008 | Brennan et al. |
| 2012/0166108 | A1 | 6/2012 | Whittaker |
| 2014/0245826 | A1 | 9/2014 | Pope et al. |
| 2016/0130935 | A1 | 5/2016 | Manzar et al. |
| 2017/0051607 | A1 | 2/2017 | Whittaker |
| 2017/0184502 | A1 | 6/2017 | Andrews et al. |
| 2017/0198574 | A1 | 7/2017 | Donzier et al. |
| 2017/0219737 | A1 | 8/2017 | Donzier et al. |
| 2018/0003027 | A1 | 1/2018 | Donzier et al. |
| 2018/0363449 | A1 | 12/2018 | Ratcliffe et al. |
| 2020/0200942 | A1 | 6/2020 | Main et al. |
| 2020/0208514 | A1 | 7/2020 | Swett et al. |
| 2020/0362645 | A1 | 11/2020 | Donzier et al. |
| 2021/0222540 | A1 | 6/2021 | Kroczka et al. |
| 2021/0270647 | A1 | 9/2021 | Xie |
| 2021/0349068 | A1 | 11/2021 | Bremner et al. |
| 2022/0106878 | A1 | 4/2022 | Al-Huwaider et al. |
| 2022/0307364 | A1 | 9/2022 | Rowe et al. |
| 2023/0031721 | A1 | 2/2023 | Stewart et al. |
| 2024/0240558 | A1 | 7/2024 | Andrews et al. |
| 2024/0243641 | A1 | 7/2024 | Smith |

OTHER PUBLICATIONS

Chowdhury et al. (2019). Production Logging and its Implementation: A Technical Review. International Journal of Petroleum and Petrochemical Engineering. 5. 42-51. https://doi.org/10.20431/2454-7980.0502004; 10 pages.

Li et al. Raman vibrational spectral characteristics and quantitative analysis of H2up to 400° C. and40 MPa. J Raman Spectrosc. 2018; 49:1722-1731. https://doi.org/10.1002/jrs.5420; 10 pages.

Dąbrowski et al.; Downhole measurements and determination of natural gas composition using Raman spectroscopy, Journal of Natural Gas Science and Engineering, vol. 65, 2019, pp. 25-31, ISSN 1875-5100, https://doi.org/10.1016/j.jngse.2019.02.003.; 7 pages.

Wang et al.; (2021), Quantitative analysis of coal-bed methane components by downhole laser Raman spectroscopy; Interpretation 9: B1-B6. https://doi.org/10.1190/INT-2020-0206.1; 11 pages.

Luo et al.; Application and Analysis of Array Production Logging Technology for Multiphase Flow in Horizontal Wells; Processes 2023, 11, 3421; 17 pages.

Ahmad et al.;Array Production Survey Accurately Pinpoints Water Shut-Off Location and Strengthen the Understanding on Remaining Potential of a Giant Carbonate Gas Field, Offshore East Malaysia; SPE-205785-MS (Year: 2021); 30 pages.

No author; Proactive Diagnostic Services; Multiple Array Production Suite (MAPS); (Year: 2017); 2 pages.

Office Action in corresponding U.S. Appl. No. 18/636,015 mailed Sep. 6, 2024; 37 pages.

* cited by examiner

APPARATUS AND METHOD FOR IN-SITU MONITORING OF HYDROGEN LEVELS AT A SUBSURFACE LOCATION

FIELD OF THE DISCLOSURE

The present disclosure generally relates to energy storage and extraction and, more specifically, to a tool and technique for conducting in-situ determinations of hydrogen levels at a subsurface location, such as a natural resource reservoir.

BACKGROUND OF THE DISCLOSURE

With continued developments in seeking energy sources with reduced carbon output, there is growing interest in hydrogen as a low-carbon fuel. Key challenges for using hydrogen as a viable energy medium are its storage and transportation. The present disclosure addresses hydrogen storage by providing a heretofore unavailable hydrogen monitoring tool usable for storage applications.

SUMMARY OF THE DISCLOSURE

Hydrogen produced from excess energy supply can be stored in large quantities and used later. Accordingly, subsurface hydrogen storage is becoming increasingly important due to its large scale capacity, which makes it technically and economically feasible. For many years, depleted hydrocarbon reservoirs and saline aquifers have been successfully used as subsurface storages for natural gas. However, unlike natural gas storage, hydrogen interactions with reservoir fluid and rock are not well understood and reactions may occur via different mechanisms.

With the continued developments in using and storing hydrogen, there is an ongoing need for downhole tools that can monitor hydrogen productions. Production logging is a well-known technique used in conventional hydrocarbon extraction operations to determine flow and fluid properties based on velocity, density, pressure and temperature measurements in a reservoir. Although these measurements provide for differentiating gas, oil, and water, they are not designed to detect hydrogen. In other words, there are no existing tools capable of detecting and quantifying hydrogen flow potential from subsurface storages. This is vitally important in order to assess the subsurface hydrogen storages in terms of delivery rate and working capacity.

The present disclosure generally relates to an in-situ hydrogen monitoring apparatus and method to ascertain hydrogen behavior in subsurface reservoirs and to, thereby, assess the performance of intermediate-to-long-term subsurface storage reservoirs. More specifically, in view of the developed field of conventional production logging, the present disclosure is directed to a new logging tool that is compatible with existing logging infrastructure and that is capable of detecting hydrogen presence in subsurface reservoirs, quantifying flow potential, and detecting any changes in produced hydrogen compositions.

According to one or more example implementations consistent with the present disclosure, a sonde adapted for determining one or more parameters related to hydrogen at a subsurface location, comprises: a plurality of centralizer arms forming an interior space having a proximal portion and a distal portion; a plurality of fiber optic Raman probes each disposed at the proximal portion or the distal portion of the interior space and proximate a respective one of the plurality of centralizer arms, said plurality of fiber optic Raman probes being adapted to measure a hydrogen concentration in a downhole measurement; and a plurality of optical probes each disposed at another of the distal portion or the proximal portion of the interior space and proximate a same or different one of the plurality of centralizer arms, said plurality of optical probes being adapted to measure downhole local gas holdup. In one or more example implementations, the plurality of fiber optic Raman probes and the plurality of optical probes are disposed at respective interior perimeters having diameters that are fractions of respective outer circumference diameters formed by the plurality of centralizer arms.

In one or more example implementations, the plurality of centralizer arms are bowspring centralizer arms. In one or more example implementations, the plurality of fiber optic Raman probes are adapted to detect signal bands of hydrogen molecules. In one or more example implementations, the plurality of fiber optic Raman probes are adapted to detect signal spectra with wavenumbers at about 4,100-4,175 $cm^{-1}$.

In one or more example implementations, the detected signal with wavenumbers at about 4, 125-4, 165 $cm^{-1}$ are processed based on one or more of a temperature determined using the temperature probe and a pressure determined using the pressure probe. In one or more example implementations, the sonde further comprises a flowmeter disposed at the proximal portion or the distal portion of the interior space. In one or more example implementations, the sonde further comprises an additional flowmeter disposed at another of the proximal portion or the distal portion of the interior space.

In one or more example implementations, the flowmeter and the additional flowmeter are rotationally offset from each other in relation to a longitudinal axis along the sonde. In one or more example implementations, the plurality of fiber optic Raman probes are disposed proximate to same ones of the plurality of centralizer arms as the plurality of optical probes.

In one or more example implementations, the plurality of fiber optic Raman probes are disposed proximate to different ones of the plurality of centralizer arms from the plurality of optical probes. In one or more example implementations, the plurality of centralizer arms comprise at least six (6) centralizer arms, and the fiber optic Raman probes comprise six (6) fiber optic Raman probes that are disposed proximate to respective ones of the at least six (6) centralizer arms at 60 degrees from one another around an interior perimeter of the sonde.

In one or more example implementations, the plurality of optical probes comprise six (6) optical probes that are disposed proximate to respective ones of the at least six (6) centralizer arms at 60 degrees from one another around another interior perimeter of the sonde. In one or more example implementations, the sonde further comprises a coupling to a downhole logging tool incorporating one or more detectors selected from the group consisting of: a pressure probe, a temperature probe, a depth detector, and a fluid density measurement detector. In one or more example implementations, the downhole logging tool comprises one or more processing devices adapted to process at least signal data obtained from the plurality of optical probes and the plurality of fiber optic Raman probes.

In one or more example implementations, the one or more processing devices comprise a field programmable gate array (FPGA) device. In one or more example implementations, the sonde further comprises a coupling to an additional sonde, said additional sonde comprising: a plurality of centralizer arms forming an interior space having a proximal portion, a distal portion; a plurality of fiber optic Raman probes each disposed at the proximal portion or the distal portion of the interior space and proximate a respective one of the plurality of centralizer arms, said plurality of fiber optic Raman probes being adapted to determine a hydrogen concentration in a downhole measurement; and a plurality of optical probes each disposed at another of the distal portion or the proximal portion of the interior space and proximate a same or different one of the plurality of centralizer arms, said plurality of optical probes being adapted to measure downhole local gas holdup. In one or more example implementations, the additional sonde is rotationally offset from the sonde in relation to a longitudinal axis along the sonde.

In one or more example implementations, the offset is about 30 degrees.

According to one or more example implementations consistent with the present disclosure, method for determining one or more parameters related to hydrogen at a subsurface location, comprises: deploying a sonde to the subsurface location; recording signal data from the sonde; and withdrawing the sonde from the subsurface location, wherein the sonde comprises: a plurality of centralizer arms forming an interior space having a proximal portion and a distal portion; a plurality of fiber optic Raman probes each disposed at the proximal portion or the distal portion of the interior space and proximate a respective one of the plurality of centralizer arms, said plurality of fiber optic Raman probes being adapted to measure a hydrogen concentration in a downhole measurement; and a plurality of optical probes each disposed at another of the distal portion or the proximal portion of the interior space and proximate a same or different one of the plurality of centralizer arms, said plurality of optical probes being adapted to measure downhole local gas holdup.

BRIEF DESCRIPTION OF THE DRAWING FIGURES

Various example implementations of this disclosure will be described in detail, with reference to the following figures, wherein.

DETAILED DESCRIPTION OF CERTAIN EMBODIMENTS OF THE DISCLOSURE

As an overview, the present disclosure generally concerns energy storage and extraction and, more specifically, directed to techniques involving the use of depleted hydrocarbon reservoirs for energy storage—as an example, for storing hydrogen as an energy storage medium.

Optimizing hydrogen injection and withdrawal from depleted hydrocarbon reservoirs requires an enhanced understanding of the production and injection profiles. Existing production logging techniques lack specific hydrogen detection capabilities that are required to effectively monitor the hydrogen injections and withdrawals.

The present disclosure is directed to an innovative subsurface sensing system and production logging tool and method for in-situ hydrogen monitoring to quantify flow potential and the changes in produced hydrogen compositions from subsurface hydrogen storages.

According to example implementations of the present disclosure, miniature downhole Raman sensors are integrated with production/flow logging sensors for hydrogen monitoring and surveillance. Raman spectroscopy is capable of providing structural fingerprints for different molecules in a sample, including homonuclear diatomic molecules such as hydrogen.

Figure 1:
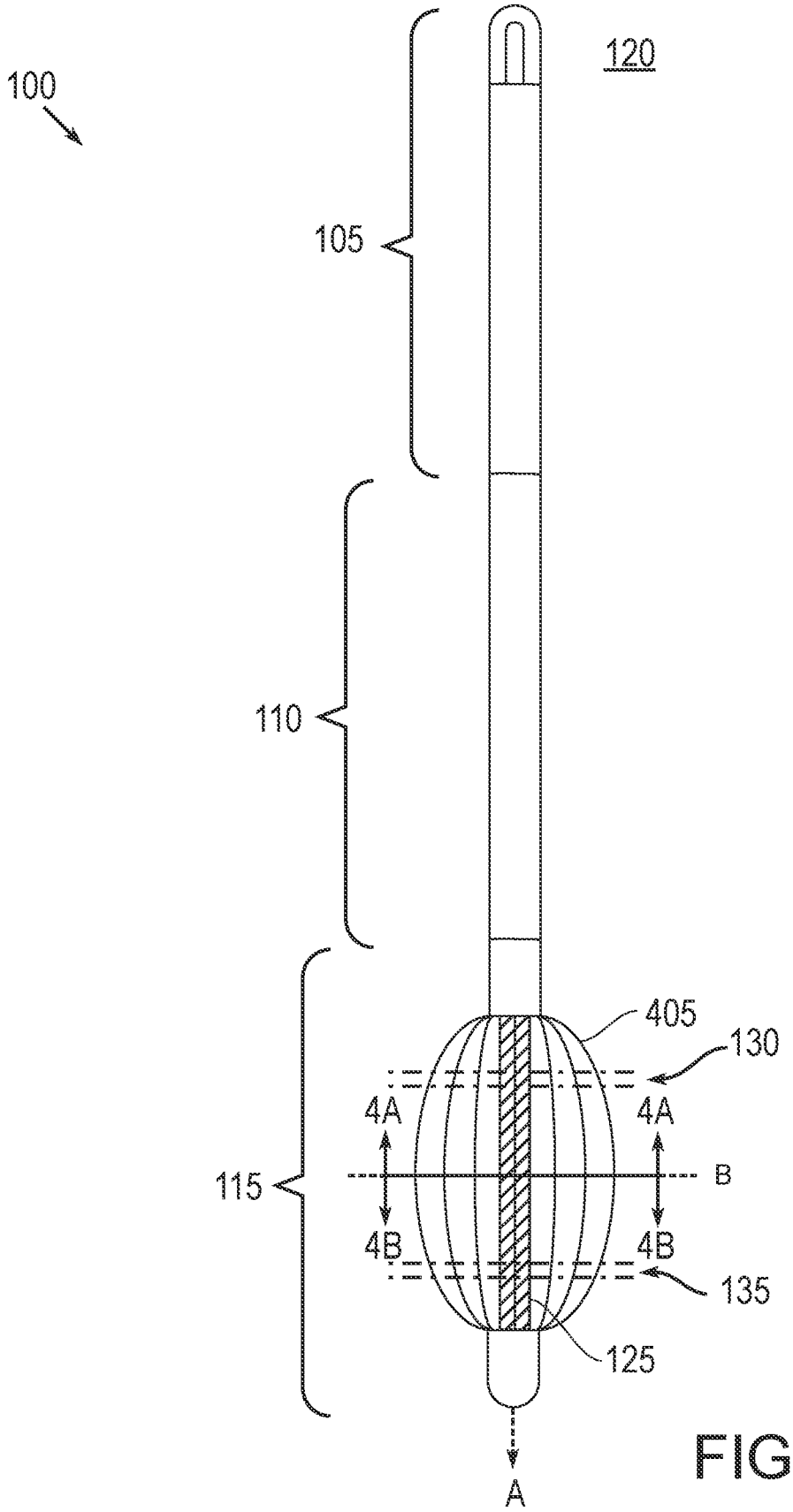
FIG. 1 is a schematic diagram illustrating a wireline logging tool according to one or more example implementations of the present disclosure.

FIG. 1 is a schematic diagram illustrating a wireline logging tool 100 according to one or more example implementations of the present disclosure. As illustrated in FIG. 1, tool 100 is a slim toolstring that includes a cartridge portion 105, a first portion 110, and a second portion 115. In one or more example implementations, first portion 110 and second portion 115 embody respective sondes or probes that include the components described and shown with reference to FIGS. 3-5—for example, first sonde or first sonde portion 110 and second sonde or second sonde portion 115. As used herein, a sonde refers to an instrument probe that automatically transmits information about its surroundings from an inaccessible location, such as underground or underwater. According to one or more example implementations, tool 100 has a total length of about 2.2 meters (m) (or about 1.5 m to about 3 m) and an outer diameter (OD) of about 3.4 centimeters (cm) (or about 3.0 cm to about 5.0 cm) at one or more of cartridge portion 105 and first portion 110.

Figure 6:
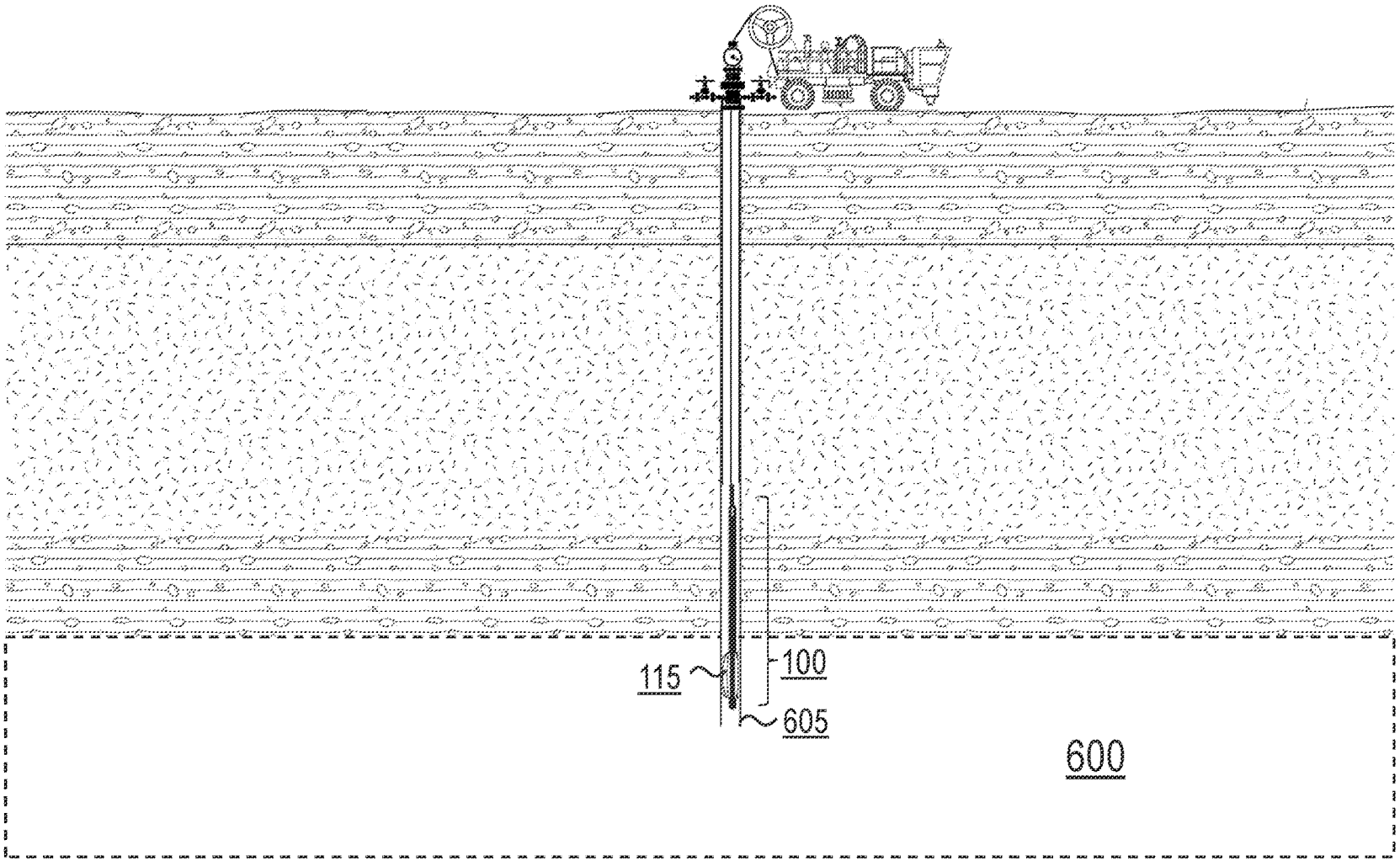
FIG. 6 is a schematic diagram of the logging tool of FIG. 1 incorporating the second portion, or sonde, of FIGS. 4A and 4B in use according to one or more example implementations of the present disclosure.

The cartridge portion 105 includes a cablehead 120 for attachment to cabling for lowering tool 100 down a wellbore (see 605 in FIG. 6). According to one or more example implementations, cartridge portion 105 hosts the power and communication instrumentations of tool 100 and cablehead 120 includes one or more connections via cabling to one or more surface apparatuses, such as an operator console (not shown) and the like, for communications with the surface. First sonde portion 110 incorporates instrumentation for basic production logging measurements, such as pressure, temperature, fluid density, depth, to name a few. Second sonde portion 115 incorporates instrumentation for advanced measurements, including specific measurements for in-situ evaluations related to hydrogen. In example implementations, such measurements can include fluid flow velocity, Raman signals, and local gas holdup. As illustrated in FIG. 1, second sonde portion 115 incorporates a plurality of centralizer arms 405 that are coupled at their respective upper/proximal and lower/distal portions to second sonde portion 115—for example, a central shaft element 125 of second sonde portion 115.

Accordingly, in embodiments, measurements taken by the instrumentation at sonde portions 110 and 115 can be recorded at cartridge portion 105 and/or transmitted in real time via a logging cable (e.g., via cablehead 120) to a surface console (not shown) for interpretation. Acquisition and interpretation software can be executed to process the raw data received from tool 100 and to analyze dynamic well performance, as well as the productivity and injectivity from subsurface reservoirs used for hydrogen storage. In embodiments, at least portions of such software can be executed by one or more onboard processors incorporated in tool 100—for example, processor(s) 210 in cartridge portion 105 in FIG. 2. In certain embodiments, at least portions of the software can be executed by one or more processors (not shown) incorporated in one or more of sonde portions 110 and 115.

Figure 2:
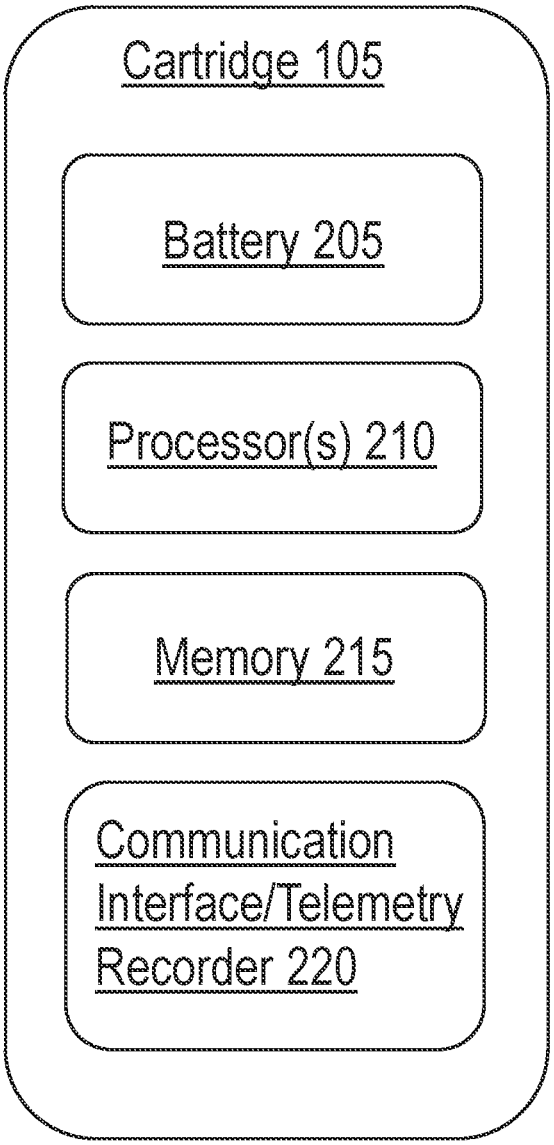
FIG. 2 is a schematic diagram illustrating the operating components of a cartridge portion of the wireline logging tool of FIG. 1 according to one or more example implementations of the present disclosure.

FIG. 2 is a schematic diagram illustrating the operating components of cartridge portion 105 according to one or more example implementations of the present disclosure. As illustrated in FIG. 2, cartridge portion 105 incorporates a battery 205, one or more processor devices 210, a memory 215, and a communication interface/telemetry recorder 220.

Battery 205 is a power source for other operating components of cartridge portion 105. In embodiments, battery 205 can be a power source for the overall tool 100, including operating components of sonde portions 110 and 115. In certain embodiments, tool 100 can be connected to an external power source, such as a surface power source, through cabling (not shown). Battery 205 can be any suitable heat and pressure resistant battery—for example, lithium-ion batteries or the like.

In one or more example implementations of the present disclosure, processor(s) 210 and memory 215 are embodied by a field programmable gate array (FPGA) based processing unit to record, process, and transfer the data recorded by tool 100 to the surface for interpretation and processing. The FPGA includes configurable logic blocks and embedded components for data processing adapted to the signal data detected via the various sensors of tool 100. According to one embodiment, the FPGA contains a 48-bit adder with an accumulator and enables efficient monitoring and processing of the data within the subsurface environment. In embodiments, one or more additional processor(s) 210 and/or memory device(s) 215, such as a microcontroller or the like, can be incorporated to handle the data recording, processing, and communication tasks.

Communication interface/telemetry recorder 220 incorporates electronics adapted to relay data obtained by tool 100 to the surface—for example, one or more computing apparatuses (not shown) operating at the surface and in communication with tool 100. In embodiments, communication interface 220 can include any suitable hardware (e.g., hardware for wired and/or wireless connections) and/or software interface among the operating components of tool 100 and one or more computing apparatuses (not shown) at the surface. According to one or more example implementations, communication interface 220 includes interconnections between the sensors of tool 100 and processor(s) 210 and memory 215 for relaying, processing, and recording the data from the sensors. In embodiments, communication interface 220 can further include wired and/or wireless connections for relaying raw and/or processed data to one or more apparatuses (not shown) at the surface.

Figure 3:
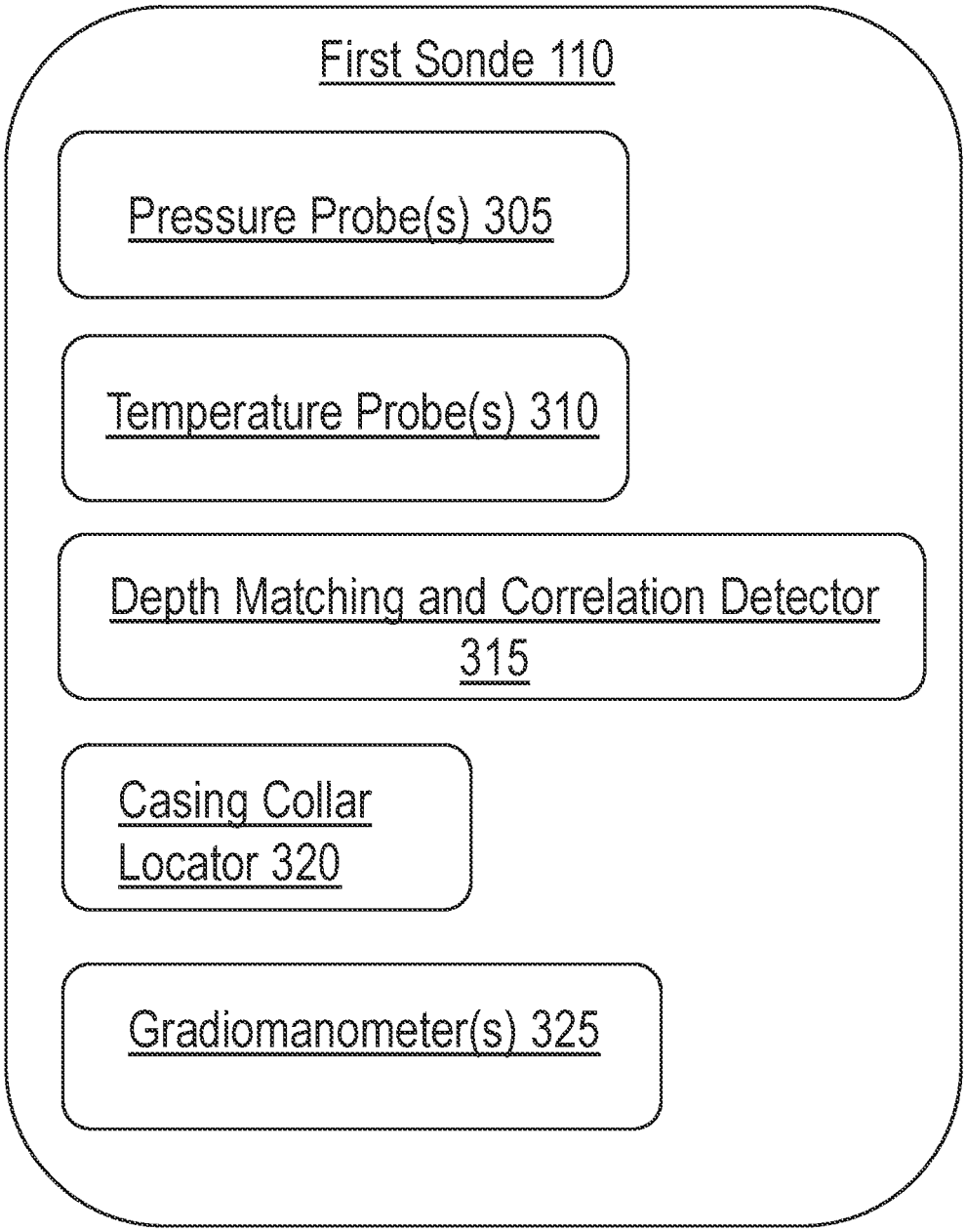
FIG. 3 is a schematic diagram illustrating the operating components of a first portion of the wireline logging tool of FIG. 1 according to one or more example implementations of the present disclosure.

FIG. 3 is a schematic diagram illustrating the operating components of first sonde portion 110 according to one or more example implementations of the present disclosure. As illustrated in FIG. 3, first sonde portion 110 incorporates one or more pressure probes 305, one or more temperature probe(s) 310, a depth matching and correlation detector 315, a casing collar locator (CCL) 320, and one or more gradiomanometers 325.

Pressure probe(s) 305 and temperature probe(s) 310 can include any suitable pressure and temperature sensors that are used, for example, in production logging for determining the pressure and temperature of the subsurface environment at which tool 100 is deployed. In embodiments, pressure probe(s) 305 and temperature probe(s) 310 can be oriented to detect localized pressure and temperature parameters in cooperation with one or more of the other sensors of tool 100—for example, for determining the flow characteristics and/or concentration of hydrogen in the subsurface environment.

In accordance with one or more example implementations, depth matching and correlation detector 315 incorporates a gamma ray detector for matching well logs—for example, raw logging-while-drilling (LWD) logs, electrical-wireline-logging (EWL) logs, or the like—and matching depth information of a wellbore (605 in FIG. 6). In embodiments, other types of depth correlation can also be used, such as optical, sonic, photoelectric factor, or the like.

According to one or more example implementations, casing collar locator (CCL) 320 comprises a coil and magnetic assembly with a downhole amplifier for detecting a magnetic flux caused by an enlarged collar of a metallic casing (not shown) of a wellbore (605 in FIG. 6).

Gradiomanometer(s) 325 derives a fluid density in a wellbore (605 in FIG. 6) by, according to one or more example implementations, incorporating a differential transducer to measure a differential pressure over the length of a column of fluid within the wellbore (605 in FIG. 6). Thus, a fluid density at a subsurface location can be determined by tool 100.

Figure 4A:
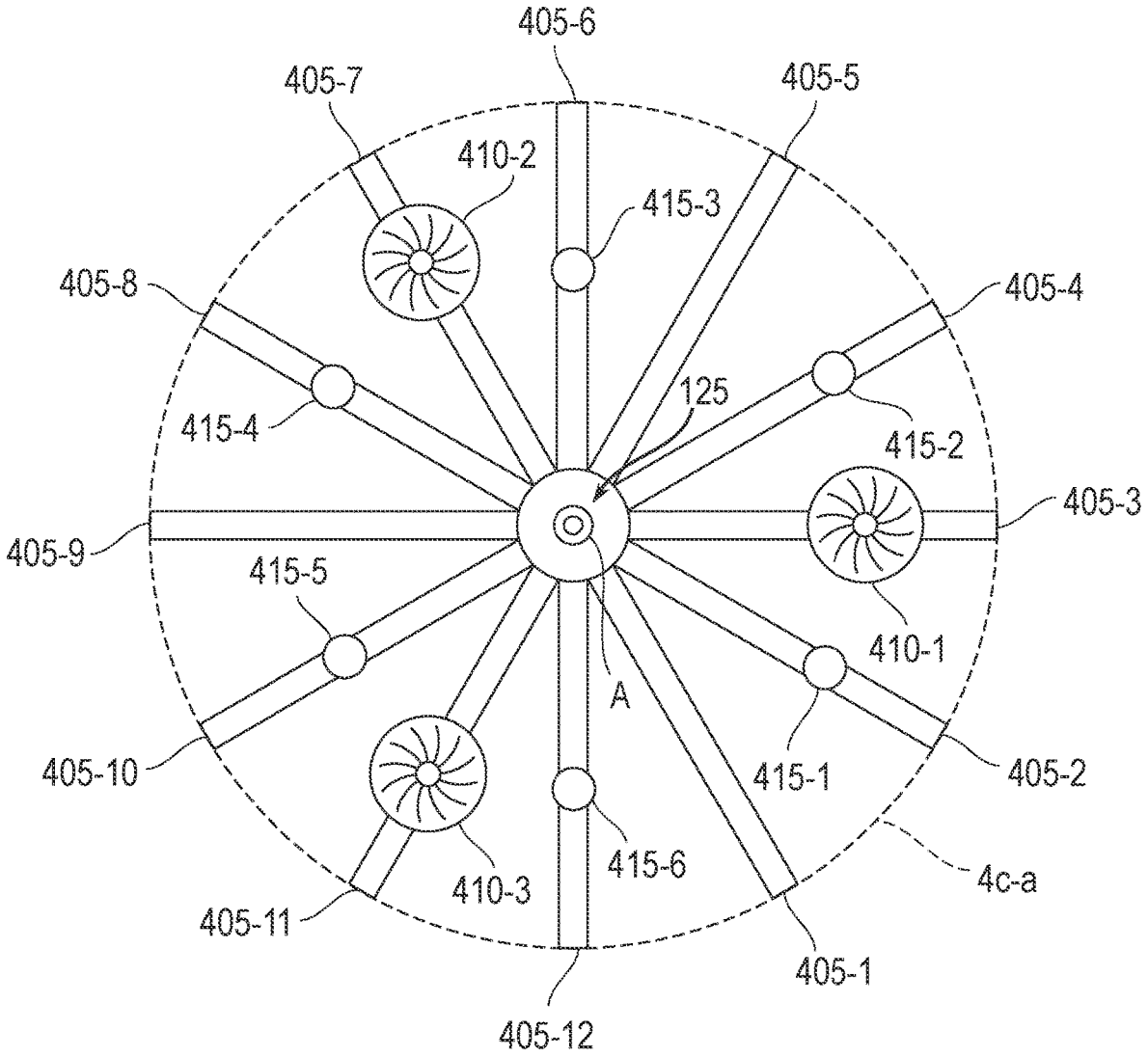
FIG. 4A is a cross-sectional view along line "B" in the 4A-4A direction in FIG. 1 of a second portion of the wireline logging tool of FIG. 1.
Figure 4B:
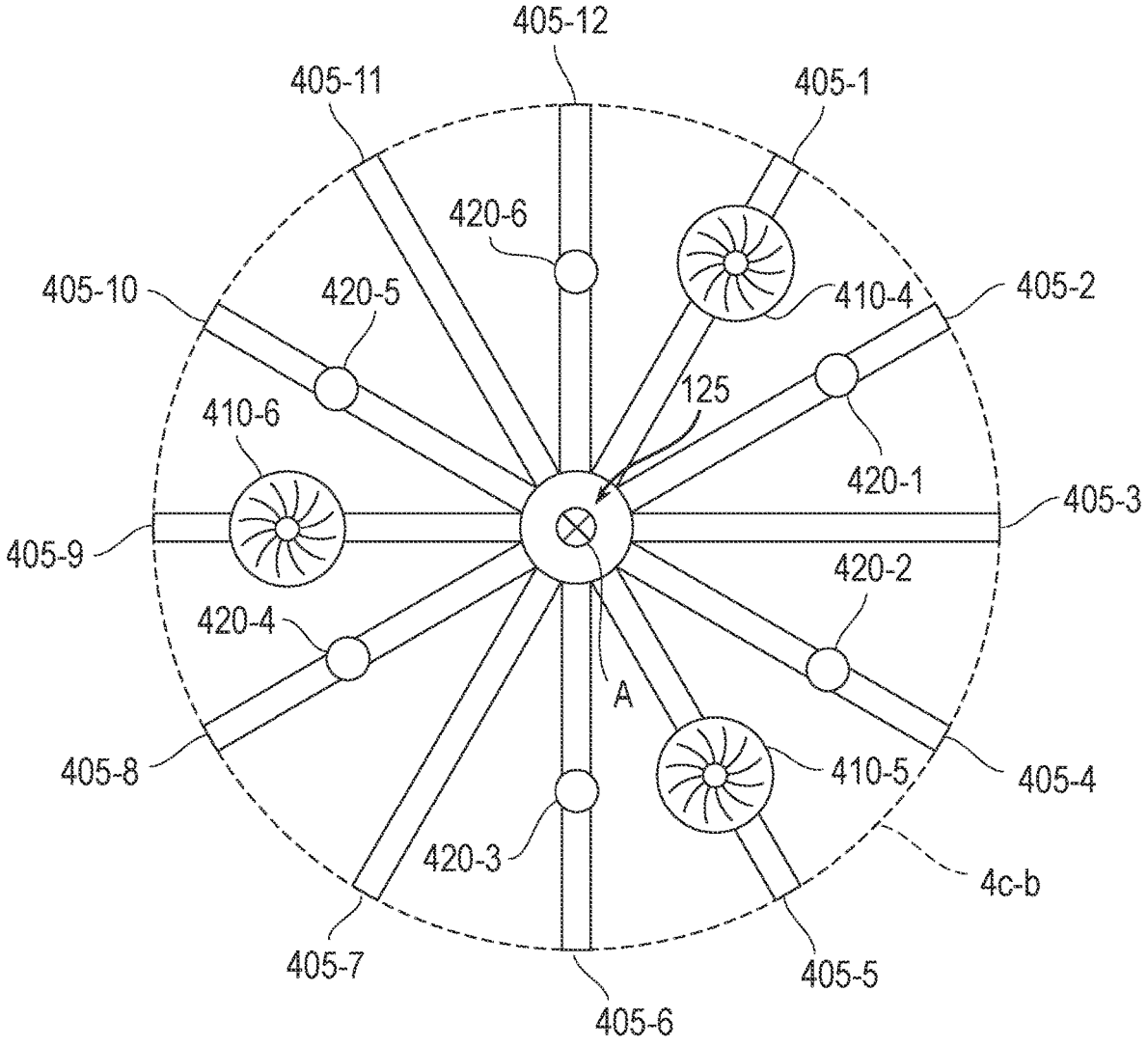
FIG. 4B is a cross-sectional view along line "B" in the 4B-4B direction in FIG. 1 of the second portion of the wireline logging tool of FIG. 1.

FIG. 4A is a cross-sectional view along line B in the 4A-4A direction in FIG. 1 of second sonde portion 115 and FIG. 4B is a cross-sectional view along line B in the 4B-4B direction in FIG. 1 of second sonde portion 115. Referring to FIG. 1, band 130 marks a location from the upper/proximal end of centralizer arms 405 that is about one quarter (¼) to one third (⅓) of the total length spanning centralizer arms 405 along a central longitudinal axis "A" of second sonde portion 115. Correspondingly, band 135 in FIG. 1 marks a location from the lower/distal end of centralizer arms 405 that is about one quarter (¼) to one third (⅓) of the total length spanning centralizer arms 405 along a central longitudinal axis "A" of second sonde portion 115. Thus, FIG. 4A provides an upward (or proximal) interior view of an upper (or proximal) portion of second sonde portion 115 and FIG. 4B a downward (or distal) interior view of a lower (or distal) portion of second sonde portion 115. In accordance with one or more example implementations of the present disclosure, second sonde portion 115 has a total length of about 1.5 meters (m) to about 3.0 m and a maximum outer diameter (OD) of about 12.1 cm (or about 4¾ inches) across a middle portion—e.g., at line "B" in FIG. 1—of centralizer arms 405.

As illustrated in FIGS. 4A and 4B, second sonde portion 115 comprises, consists essentially of, or consists of twelve (12) bowspring centralizer arms 405-1, . . . , 405-12 that are coupled to second sonde portion 115 at their respective upper/proximal and bottom/distal portions. According to one or more example implementations and as illustrated in FIGS. 4A and 4B, centralizer arms 405 are coupled at their respective upper/proximal and lower/distal portions to a central shaft portion 125 to thereby form an expanded interior space in second sonde portion 115. In embodiments, different types and numbers of centralizers can be used without departing from the spirit and scope of the present disclosure. As illustrated in FIG. 1, central shaft portion 125 extends along an entire length of the interior space formed by centralizer arms 405. In certain embodiments, central shaft portion 125 can be disconnected between the upper/proximal and lower/distal portions.

According to one or more example implementations, six (6) of the centralizer arms 405 (or half of the total number of centralizer arms 405) incorporate respective mini spinner flowmeters 410 to provide fluid velocity measurements. As illustrated in FIG. 4A, three (3) flowmeters 410-1, 410-2, and 410-3 are disposed across an upper or proximal portion of an expanded interior space formed by centralizer arms 405, for example, at band 130 in FIG. 1. According to one or more example implementations, flowmeters 410-1, 410-2, and 410-3 are disposed proximate—for example, mounted on—interior surfaces of centralizer arms 405-3, 405-7, and 405-11, respectively. Correspondingly, as illustrated in FIG. 4B, three (3) flowmeters 410-4, 410-5, and 410-6 are disposed across a lower or distal portion of an expanded interior space formed by centralizer arms 405, for example, at band 135 in FIG. 1. According to one or more example implementations, flowmeters 410-4, 410-5, and 410-6 are disposed proximate—for example, mounted on—interior surfaces of centralizer arms 405-1, 405-5, and 405-9, respectively. As shown in FIG. 4A, flowmeters 410-1, 410-2, and 410-3 are disposed around an interior perimeter at about one half (½) to about three quarters (¾) diameter of the diameter of outer circumference 4*c-a* of second sonde portion 115, for example, at band 130 of FIG. 1. According to one or more example implementations, outer circumference 4*c-a* has a diameter of about 12.1 cm (or about 4¾ inches), or the OD at line "B" in FIG. 1. Correspondingly, as shown in FIG. 4B, flowmeters 410-4, 410-5, and 410-6 are disposed around an interior perimeter at about one half (½) to about three quarters (¾) diameter of the diameter of outer circumference 4*c-b* of second sonde portion 115, for example, at band 135 of FIG. 1. According to one or more example implementations, outer circumference 4*c-b* has a diameter of about 12.1 cm (or about 4¾ inches), or the OD at line "B" in FIG. 1. Thus, flowmeters 410 are disposed in an expanded interior space formed by centralizer arms 405 at locations that are away from the maximum outer circumference of the interior space—for example, at line "B" shown in FIG. 1. As such, flowmeters 410 are adapted to determine the characteristics of a main flow within a wellbore by being place substantially away from the sidewalls of the wellbore (605 in FIG. 6). In certain embodiments, flowmeters 410 can be disposed at different locations on interior and/or exterior portions of second sonde portion 115 without departing from the spirit and scope of the present disclosure. In certain embodiments, flowmeters 410 can also determine water holdup, water/hydrocarbon bubble count, and include relative bearing measurements, to name a few. In certain embodiments, alternative types and arrangements of flowmeters can be implemented, such as a full bore spinner, continuous spinner, or the like.

According to one or more example implementations, the same centralizer arms 405-1, 405-3, 405-5, 405-7, 405-9, and 405-11 are also used as sensing elements to provide caliper measurements from the movement of the respective bowsprings for measuring one or more inclinations of a wellbore via a physical caliper.

As illustrated in FIG. 4A, six (6) fiber optic Raman probes 415-1, . . . , 415-6 are disposed around an interior perimeter at about one half (½) to about three quarters (¾) diameter of the outer circumference diameter 4*c-a* of second sonde portion 115, for example, at band 130 of FIG. 1. According to one or more example implementations, probes 415-1, . . . , 415-6 are disposed proximate—for example, mounted on-interior surfaces of respective arms 405-2, 405-4, 405-6, 405-8, 405-10, and 405-12 as shown in FIG. 4A. In other words, Raman probes 415-1, . . . , 415-6 are disposed in an upper or proximal portion of an expanded interior space formed by centralizer arms 405 and at locations that are away from the maximum outer circumference of the interior space, or the outer circumference 4*c-a*, for example, at line "B" shown in FIG. 1. Accordingly, probes 415 would be disposed away from a wellbore wall when second sonde portion 115 is deployed. Probes 415, as arranged in FIG. 4A, provide coverage around an interior perimeter of second sonde portion 115, with a probe 415 disposed every 60 degrees around the interior perimeter. In certain embodiments, more or fewer probes 415 can be disposed at regular or irregular intervals, or at particular positions depending upon the deployment environment of tool 100.

As such, probes 415 are adapted to determine the characteristics of a main flow within a wellbore by being place substantially away from the sidewalls of a wellbore (605 in FIG. 6) when second sonde portion 115 is deployed. In certain embodiments, Raman probes 415 can be disposed at different locations on interior and/or exterior portions of second sonde portion 115 without departing from the spirit and scope of the present disclosure.

Raman probes 415 operate to detect Raman signals of a fluid in a subsurface location of tool 100—for example, a wellbore. In one or more example implementations, Raman probes 415 are adapted to detect signal spectra with wavenumbers in a range of about 100-4,325 $cm^{-1}$. Accordingly, vibrational bands of hydrogen molecules-including their spin isomers, for example, ortho-hydrogen and para-hydrogen—in ranges of about 4, 100-4,175 $cm^{-1}$ are processed based on the in-situ pressure and temperature detected by pressure probe(s) 305 and temperature probe(s) 310. According to one example embodiment, signal bands in ranges of about 4,125-4,165 $cm^{-1}$ are detected and processed based on temperature and pressure conditions at the subsurface location with the wavenumbers being adjusted based on these conditions—for example, 0-400° C. (Celsius) and 0-40 MPa (Mega-Pascal). In certain embodiments, Raman probes 415 can also be adapted to detect rotational bands of hydrogen molecules in ranges of about 300-1,200 $cm^{-1}$. In certain embodiments, signal processing techniques, such as Fourier transform, wavelet transform, data processing and/or correction algorithms, to name a few, can be used to identify and process the relevant signal bands.

According to one or more example implementations, data collected by probes 415 is processed by processor(s) 210—for example, in relation to data collected by the probes and detectors of first sonde portion 110, flowmeters 410, and/or probes 420—and forwarded to a surface computing apparatus (not shown) for interpretation and/or further processing. In certain embodiments, raw data collected by probes 415 can be relayed to a surface computing apparatus (not shown) for processing and interpretation in real time. In certain embodiments, one or more processing devices (not shown) can be incorporated in second sonde portion 115 for processing data signals from probes 415.

Referring now to FIG. 4B, six (6) optical probes 420-1, . . . , 420-6 are disposed around an interior perimeter at about one half (½) to about three quarters (¾) diameter of the outer circumference diameter 4*c-b* of second sonde portion 115, for example, at band 135 of FIG. 1. According to one or more example implementations, probes 420-1, . . . , 420-6 are disposed proximate—for example, mounted on-interior surfaces of respective arms 405-2, 405-4, 405-6, 405-8, 405-10, and 405-12 as shown in FIG. 4B. In other words, optical probes 420-1, . . . , 420-6 are disposed in a lower or distal portion of an expanded interior space formed by centralizer arms 405 and at locations that are away from the maximum outer circumference of the interior space—for example, at line "B" shown in FIG. 1. Accordingly, probes 420 would be disposed away from a wellbore wall when second sonde portion 115 is deployed. Probes 420, as arranged in FIG. 4B, provide coverage around an interior perimeter of second sonde portion 115 (or the expanded interior space thereof), with a probe 420 disposed every 60 degrees around the interior perimeter. In the illustrated implementation, probes 420 are vertically aligned with probes 415 by being disposed proximate to the same centralizer arms 405. In certain embodiments, more or fewer probes 420 can be disposed at regular or irregular intervals, or at particular positions, including positions that are vertically offset from probes 415, depending upon the deployment environment of tool 100.

As such, probes 420 are adapted to determine the characteristics of a main flow within a wellbore by being place substantially away from the sidewalls of the wellbore (605 in FIG. 6) when second sonde portion 115 is deployed. In certain embodiments, optical probes 420 can be disposed at different locations on interior and/or exterior portions of second sonde portion 115 without departing from the spirit and scope of the present disclosure.

According to one or more example implementations, probes 420 are Gas Holdup Optical Sensor Tool ("GHOST") probes that operate to measure local gas holdup in a subsurface location of tool 100—for example, a wellbore. In certain embodiments, probes 420 can also include gas/liquid bubble count, caliper, and relative bearing measurements, to name a few.

According to one or more example implementations, data collected by probes 420 is processed by processor(s) 210—for example, in relation to data collected by the probes and detectors of first sonde portion 110, flowmeters 410, and/or probes 415—and forwarded to a surface computing apparatus (not shown) for interpretation and/or further processing. In certain embodiments, raw data collected by probes 420 can be relayed to a surface computing apparatus (not shown) for processing and interpretation in real time. In certain embodiments, one or more processing devices (not shown) can be incorporated in second sonde portion 115 for processing data signals from probes 420.

As illustrated in FIGS. 1, 4A, and 4B, centralizer arms 405 form an expanded interior space—for example, a prolate spheroid—with a maximum outer circumference at about a middle line—for example, line "B" in FIG. 1—between an upper/proximal point and a bottom/distal point of each centralizer arm 405. According to one or more example implementations, each centralizer arm 405 is a bowspring coupled to a central shaft element 125 of second sonde portion 115 at the respective upper/proximal and lower/distal points. In certain embodiments, different types of centralizer arms 405 adapted for forming a centered interior space from a borehole wall (not shown) can be incorporated in second sonde portion 115 without departing from the spirit and scope of the present disclosure.

Referring back to FIGS. 4A and 4B, the probes 415/420 and flowmeters 410 are disposed at a middle portion within the expanded interior space formed by centralizer arms 405 proximate the upper/proximal and lower/distal positions, which are indicated, for example, by bands 130 and 135 in FIG. 1, respectively. Thus, advantageously, the probes 415/420 and flowmeters 410 are disposed sufficiently away from a borehole wall circumferentially to capture a main flow of a well. Additionally, accounting for the lower density of hydrogen, probes 415 are arranged on an upper (or proximal) portion of second sonde portion 115 in relation to probes 420 for measurements in vertical wellbores. In certain embodiments, probes 415 and probes 420 can be offset from one another by being disposed on different centralizer arms 405 from one another at respective upper (or proximal) portions and lower (or distal) portions. In certain embodiments, probes 415 and 420 and be disposed at different positions—for example, probe 415 at a distal portion of second sonde portion 115 or probe 420 at a proximal portion of second sonde portion 115—depending upon the deployment environment of tool 100.

As further illustrated in FIGS. 4A and 4B, flowmeters 410-1, 410-2, and 410-3 are arranged on centralizer arms 405-3, 405-7, and 405-11 between respective pairs of probes 415-1 and 415-2, 415-3 and 415-4, and 415-5 and 415-6, respectively, and flowmeters 410-4, 410-5, and 410-6 are rotationally offset from flowmeters 410-1, 410-2, and 410-3 in relation to a central longitudinal axis along second sonde portion 115—see, for example, axis "A" in FIGS. 1, 4A, and 4B—by being arranged on centralizer arms 405-1, 405-5, and 405-9 between the other pairs of probes 420-2 and 420-3, 420-4 and 420-5, and 420-6 and 420-1. As shown in FIGS. 4A and 4B, the offset is about 60 degrees. In certain embodiments, the rotational offset can be between 1-59 degrees or 61-119 degrees. Thus, flow characteristics, or any differences, between the upper/proximal and lower/distal portions of second sonde portion 115 can be determined based on the offset arrangement of flowmeters 410. This arrangement also provides for circumferential coverage in flow characteristic determinations. In certain embodiments, flowmeters 410-1, 410-2, and 410-3 can be vertical or horizontally aligned with flowmeters 410-4, 410-5, and 410-6. In certain embodiments, different numbers of centralizer arms 405, flowmeters 410, and/or probes 415/420 can be used with attendant alignments and/or offsets without departing from the spirit and scope of the present disclosure.

In certain embodiments, tool 100 can be used for measurements in horizontal deployments with flowmeters 410, probes 415, and probes 420 encircling an interior perimeter of second sonde portion 115 away from the outermost circumference of arms 405, or a borehole wall.

According to one or more example implementations of the present disclosure, all sonde subs—for example, cartridge 105, first sonde portion 110, and second sonde portion 115—are connected to one another via threaded connections for convenient replacements and rearrangements—for example, using a modular structure. In case more measurements are required, dual configurations of second sonde portion 115 can be deployed.

Figure 5:
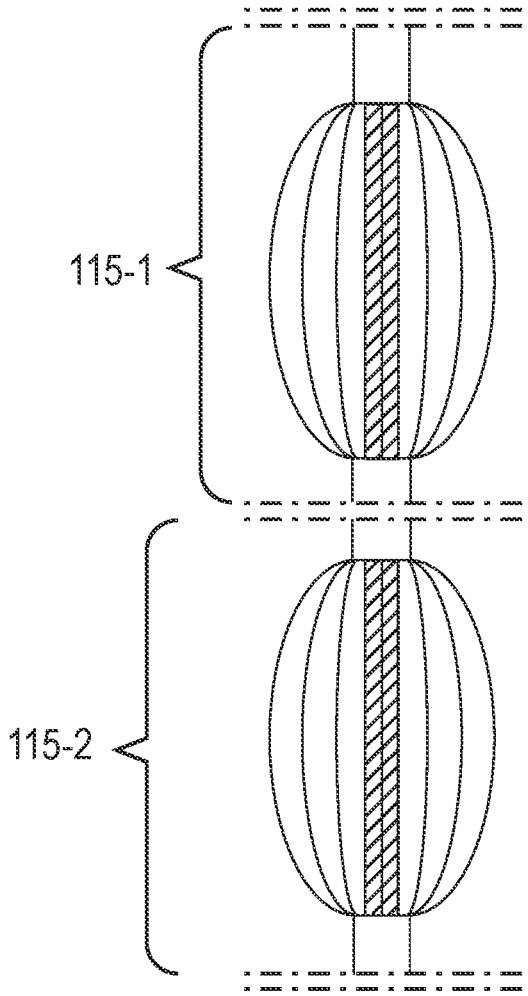
FIG. 5 is a schematic diagram illustrating plural second portions connected to one another in a tandem configuration according to one or more example implementations of the present disclosure.

FIG. 5 is a schematic diagram illustrating two (2) second sonde portions 115-1 and 115-2 connected to each other in a tandem configuration according to one or more example implementations of the present disclosure. As illustrated in FIG. 5, an additional second sonde portion 115-2 can be connected to the lower end of advance sonde portion 115-1, which can correspond to second sonde portion 115 shown in FIG. 1 in relation to the other portions of tool 100. Such a dual configuration of the second sonde portions 115-1 and 115-2 is capable of acquiring further fluid information from the borehole. In certain embodiments, the respective portions 105, 110, and 115 of tool 100, as illustrated in FIG. 1, can be rearranged in different configurations without departing from the spirit and the scope of the present disclosure. As one example, additional second sonde portion 115-2 can be disposed between cartridge 105 and first sonde portion 110. According to one or more example implementations, second sonde portions 115-1 and 115-2 are rotationally offset from each other in relation to a longitudinal axis along tool 100—see, for example, axis "A" in FIG. 1. Such a rotational offset provides for circumferential coverage among the flowmeters 410, probes 415, and probes 420 of these second sonde portions 115-1 and 115-2. According to one or more example implementations, the offset is about 30 degrees. In certain embodiments, the rotational offset can be between 1-119 degrees. These values and ranges correspond to the example implementation illustrated in FIGS. 4A and 4B. Other values and ranges can be implemented based on the number of respective centralizer arms 405, corresponding probes 415/420, and/or flowmeters 410 without departing from the spirit and scope of the present disclosure. In certain embodiments, further additional sonde portions 115-*x* (x>2; or x<=4) can be deployed.

There are numerous issues related to hydrogen storage using subsurface formations. For example, the biogeochemical changes due to high microbial activity or contamination by other gases, such as hydrogen sulfide and methane, can impact the quality of stored hydrogen. Additionally, the presence of high cushion gas can affect storage performance in terms of delivery rate and working capacity. Advantageously, second sonde portion 115 of the present disclosure provides for a specific tool usable with existing production logging infrastructure for hydrogen-specific measurements. FIG. 6 is a schematic diagram of tool 100 incorporating second sonde portion 115 in use during hydrogen injection and extraction, respectively, according to one or more example implementations of the present disclosure. As illustrated in FIG. 6, tool 100 can be lowered near reservoir region 600 down wellbore 605 for measurements in a manner similar to production logging. During hydrogen injection to or extraction from reservoir region 600, which can include a depleted hydrocarbon reservoir, enclosed subsurface structural formation, or the like, tool 100 with second sonde portion 115 is capable of measuring hydrogen flow parameters, concentrations, to name a few. In certain embodiments, second sonde portion 115 can be a self-contained tool (sonde) that is lowered to a subsurface location for hydrogen-related measurements. Thus, according to one or more example implementations, a method for determining hydrogen-related parameters—concentration, flow parameters, quantity, to name a few—in a subsurface location, such as a wellbore, comprises deploying second sonde portion 115 to the subsurface location, recording signal data from second sonde portion 115, and withdrawing second sonde portion 115 from the subsurface location. Hydrogen injection or extraction can be initiated or terminated before, during, or after each of these steps.

In certain embodiments, second sonde portion 115 can be incorporated in a permanent or semi-permanent downhole measurement tool for hydrogen monitoring at a subsurface location. A permanent or semi-permanent measurement device and downhole monitoring tool incorporating features of second sonde portion 115 is described in commonly-owned and U.S. patent application Ser. No. 18/636,015 filed on Apr. 15, 2024, the entire contents of which are incorporated by reference herein.

According a first example implementation consistent with the present disclosure, a sonde adapted for determining one or more parameters related to hydrogen at a subsurface location, comprises: a plurality of centralizer arms forming an interior space having a proximal portion and a distal portion; a plurality of fiber optic Raman probes each disposed at the proximal portion or the distal portion of the interior space and proximate a respective one of the plurality of centralizer arms, said plurality of fiber optic Raman probes being adapted to measure a hydrogen concentration in a downhole measurement; and a plurality of optical probes each disposed at another of the distal portion or the proximal portion of the interior space and proximate a same or different one of the plurality of centralizer arms, said plurality of optical probes being adapted to measure downhole local gas holdup.

In a second example implementation, the plurality of fiber optic Raman probes and the plurality of optical probes of the first example implementation are disposed at respective interior perimeters having diameters that are fractions of respective outer circumference diameters formed by the plurality of centralizer arms.

In a third implementation, the plurality of centralizer arms of the first or second example implementations are bow-spring centralizer arms.

In a fourth example implementation, the plurality of fiber optic Raman probes of any of the first through third example implementations are adapted to detect signal bands of hydrogen molecules. In a fifth example implementation, the plurality of fiber optic Raman probes of fourth example implementation the are adapted to detect signal spectra with wavenumbers at about 4,100-4,175 $cm^{-1}$.

In one or more example implementations, the detected signal with wavenumbers at about 4, 125-4, 165 $cm^{-1}$ are processed based on one or more of a temperature determined using the temperature probe and a pressure determined using the pressure probe.

In one or more example implementations, the sonde further comprises a flowmeter disposed at the proximal portion or the distal portion of the interior space.

In one or more example implementations, the sonde further comprises an additional flowmeter disposed at another of the proximal portion or the distal portion of the interior space.

In one or more example implementations, the flowmeter and the additional flowmeter are rotationally offset from each other in relation to a longitudinal axis along the sonde.

In one or more example implementations, the plurality of fiber optic Raman probes are disposed proximate to same ones of the plurality of centralizer arms as the plurality of optical probes. In one or more example implementations, the plurality of fiber optic Raman probes are disposed proximate to different ones of the plurality of centralizer arms from the plurality of optical probes.

In one or more example implementations, the plurality of centralizer arms comprise at least six (6) centralizer arms, and the fiber optic Raman probes comprise six (6) fiber optic Raman probes that are disposed proximate to respective ones of the at least six (6) centralizer arms at 60 degrees from one another around an interior perimeter of the sonde.

In one or more example implementations, the plurality of optical probes comprise six (6) optical probes that are disposed proximate to respective ones of the at least six (6) centralizer arms at 60 degrees from one another around another interior perimeter of the sonde.

In one or more example implementations, the sonde further comprises a coupling to a downhole logging tool incorporating one or more detectors selected from the group consisting of: a pressure probe, a temperature probe, a depth detector, and a fluid density measurement detector.

In one or more example implementations, the downhole logging tool comprises one or more processing devices adapted to process at least signal data obtained from the plurality of optical probes and the plurality of fiber optic Raman probes.

In one or more example implementations, the one or more processing devices comprise a field programmable gate array (FPGA) device.

In one or more example implementations, the sonde further comprises a coupling to an additional sonde, said additional sonde comprising: a plurality of centralizer arms forming an interior space having a proximal portion, a distal portion; a plurality of fiber optic Raman probes each disposed at the proximal portion or the distal portion of the interior space and proximate a respective one of the plurality of centralizer arms, said plurality of fiber optic Raman probes being adapted to determine a hydrogen concentration in a downhole measurement; and a plurality of optical probes each disposed at another of the distal portion or the proximal portion of the interior space and proximate a same or different one of the plurality of centralizer arms, said plurality of optical probes being adapted to measure downhole local gas holdup.

In one or more example implementations, the additional sonde is rotationally offset from the sonde in relation to a longitudinal axis along the sonde. In one or more example implementations, the offset is about 30 degrees.

According to one or more example implementations consistent with the present disclosure, method for determining one or more parameters related to hydrogen at a subsurface location, comprises: deploying a sonde to the subsurface location; recording signal data from the sonde; and withdrawing the sonde from the subsurface location, wherein the sonde comprises: a plurality of centralizer arms forming an interior space having a proximal portion and a distal portion; a plurality of fiber optic Raman probes each disposed at the proximal portion or the distal portion of the interior space and proximate a respective one of the plurality of centralizer arms, said plurality of fiber optic Raman probes being adapted to measure a hydrogen concentration in a downhole measurement; and a plurality of optical probes each disposed at another of the distal portion or the proximal portion of the interior space and proximate a same or different one of the plurality of centralizer arms, said plurality of optical probes being adapted to measure downhole local gas holdup.

Portions of the methods described herein can be performed by software or firmware in machine readable form on a tangible (e.g., non-transitory) storage medium. For example, the software or firmware can be in the form of a computer program including computer program code adapted to cause the system to perform various actions described herein when the program is run on a computer or suitable hardware device, and where the computer program can be embodied on a computer readable medium. Examples of tangible storage media include computer storage devices having computer-readable media such as disks, thumb drives, flash memory, and the like, and do not include propagated signals. Propagated signals can be present in a tangible storage media. The software can be suitable for execution on a parallel processor or a serial processor such that various actions described herein can be carried out in any suitable order, or simultaneously.

The headings used herein are for organizational purposes only and are not meant to be used to limit the scope of the description or the claims. As used throughout this application, the words "may" and "can" are used in a permissive sense (i.e., meaning having the potential to), rather than the mandatory sense (i.e., meaning must). To facilitate understanding, like reference numerals have been used, where possible, to designate like elements common to the figures. In certain instances, a letter suffix following a dash ( . . . -b) denotes a specific example of an element marked by a particular reference numeral (e.g., 210-*b*). Description of elements with references to the base reference numerals (e.g., 210) also refer to all specific examples with such letter suffixes (e.g., 210-*b*), and vice versa.

It is to be further understood that like or similar numerals in the drawings represent like or similar elements through the several figures, and that not all components or steps described and illustrated with reference to the figures are required for all embodiments or arrangements.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof, and are meant to encompass the items listed thereafter and equivalents thereof as well as additional items.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third) is for distinction and not counting. For example, the use of "third" does not imply there is a corresponding "first" or "second." Also, the phraseology and terminology used herein is for the purpose of description and should not be regarded as limiting.

While the disclosure has described several example implementations, it will be understood by those skilled in the art that various changes can be made, and equivalents can be substituted for elements thereof, without departing from the spirit and scope of the disclosure. In addition, many modifications will be appreciated by those skilled in the art to adapt a particular instrument, situation, or material to embodiments of the disclosure without departing from the essential scope thereof. Therefore, it is intended that the disclosure not be limited to the particular embodiments disclosed, or to the best mode contemplated for carrying out this disclosure, but that the disclosure will include all embodiments falling within the scope of the appended claims.

The subject matter described above is provided by way of illustration only and should not be construed as limiting. Various modifications and changes can be made to the subject matter described herein without following the example embodiments and applications illustrated and described, and without departing from the true spirit and scope encompassed by the present disclosure, which is defined by the set of recitations in the following claims and by structures and functions or steps which are equivalent to these recitations.

What is claimed is:

1. A sonde adapted for determining one or more parameters related to hydrogen at a subsurface location, comprising:

a plurality of centralizer arms forming an interior space having a proximal portion and a distal portion;

a plurality of fiber optic Raman probes each disposed at the proximal portion or the distal portion of the interior space and proximate a respective one of the plurality of centralizer arms, said plurality of fiber optic Raman probes being adapted to measure a hydrogen concentration in a downhole measurement; and a plurality of optical probes each disposed at another of the distal portion or the proximal portion of the interior space and proximate a same or different one of the plurality of centralizer arms, said plurality of optical probes being adapted to measure downhole local gas holdup, wherein the plurality of fiber optic Raman probes are adapted to detect signal bands of hydrogen molecules, wherein the plurality of fiber optic Raman probes are adapted to detect signal spectra with wavenumbers at about 4,100-4,175 $cm^{-1}$, and wherein a detected signal with wavenumbers at about 4,125-4,165 $cm^{-1}$ is processed based on one or more of a temperature determined using a temperature probe and a pressure determined using a pressure probe.

2. The sonde of claim 1, wherein the plurality of fiber optic Raman probes and the plurality of optical probes are disposed at respective interior perimeters having diameters that are fractions of respective outer circumference diameters formed by the plurality of centralizer arms.

3. The sonde of claim 1, wherein the plurality of centralizer arms are bowspring centralizer arms.

4. The sonde of claim 1, further comprising a flowmeter disposed at the proximal portion or the distal portion of the interior space.

5. The sonde of claim 4, further comprising an additional flowmeter disposed at another of the proximal portion or the distal portion of the interior space.

6. The sonde of claim 5, wherein the flowmeter and the additional flowmeter are rotationally offset from each other in relation to a longitudinal axis along the sonde.

7. The sonde of claim 1, wherein the plurality of fiber optic Raman probes are disposed proximate to same ones of the plurality of centralizer arms as the plurality of optical probes.

8. The sonde of claim 1, wherein the plurality of fiber optic Raman probes are disposed proximate to different ones of the plurality of centralizer arms from the plurality of optical probes.

9. The sonde of claim 1, wherein the plurality of centralizer arms comprise at least six (6) centralizer arms, and the fiber optic Raman probes comprise six (6) fiber optic Raman probes that are disposed proximate to respective ones of the at least six (6) centralizer arms at 60 degrees from one another around an interior perimeter of the sonde.

10. The sonde of claim 9, wherein the plurality of optical probes comprise six (6) optical probes that are disposed proximate respective ones of the at least six (6) centralizer arms at 60 degrees from one another around another interior perimeter of the sonde.

11. The sonde of claim 1, further comprising a coupling to a downhole logging tool incorporating one or more detectors selected from the group consisting of: a pressure probe, a temperature probe, a depth detector, and a fluid density measurement detector.

12. The sonde of claim 11, wherein the downhole logging tool comprises one or more processing devices adapted to process at least signal data obtained from the plurality of optical probes and the plurality of fiber optic Raman probes.

13. The sonde of claim 12, wherein the one or more processing devices comprise a field programmable gate array (FPGA) device.

14. The sonde of claim 1, further comprising a coupling to an additional sonde, said additional sonde comprising:

a plurality of centralizer arms forming an interior space having a proximal portion and a distal portion;

a plurality of fiber optic Raman probes each disposed at the proximal portion or the distal portion of the interior space and proximate a respective one of the plurality of centralizer arms, said plurality of fiber optic Raman probes being adapted to determine a hydrogen concentration in a downhole measurement; and a plurality of optical probes each disposed at another of the distal portion or the proximal portion of the interior space and proximate a same or different one of the plurality of centralizer arms, said plurality of optical probes being adapted to measure downhole local gas holdup.

15. The sonde of claim 14, wherein the additional sonde is rotationally offset from the sonde in relation to a longitudinal axis along the sonde.

16. The sonde of claim 15, wherein the offset is about 30 degrees.

17. A method for determining one or more parameters related to hydrogen at a subsurface location, comprising:

deploying a sonde to the subsurface location;

recording signal data from the sonde; and withdrawing the sonde from the subsurface location, wherein the sonde comprises:

a plurality of centralizer arms forming an interior space having a proximal portion and a distal portion;

a plurality of fiber optic Raman probes each disposed at the proximal portion or the distal portion of the interior space and proximate a respective one of the plurality of centralizer arms, said plurality of fiber optic Raman probes being adapted to measure a hydrogen concentration in a downhole measurement; and a plurality of optical probes each disposed at another of the distal portion or the proximal portion of the interior space and proximate a same or different one of the plurality of centralizer arms, said plurality of optical probes being adapted to measure downhole local gas holdup, wherein the plurality of fiber optic Raman probes are adapted to detect signal bands of hydrogen molecules, wherein the plurality of fiber optic Raman probes are adapted to detect signal spectra with wavenumbers at about 4,100-4,175 $cm^{-1}$, and wherein a detected signal with wavenumbers at about 4,125-4,165 $cm^{-1}$ is processed based on one or more of a temperature determined using a temperature probe and a pressure determined using a pressure probe.

* * * * *